US006773522B1

(12) United States Patent
Bodin et al.

(10) Patent No.: US 6,773,522 B1
(45) Date of Patent: Aug. 10, 2004

(54) PROCESS AND DEVICE FOR PRODUCING A HIGH-STRENGTH STEEL STRIP

(75) Inventors: André Bodin, Santpoort-Noord (NL); Thomas Martinus Hoogendoorn, Aerdenhout (NL)

(73) Assignee: Corus Staal BV, Ca Ijmuiden (NL)

( * ) Notice: Subject to any disclaimer, the term of this patent is extended or adjusted under 35 U.S.C. 154(b) by 0 days.

(21) Appl. No.: 09/555,402

(22) PCT Filed: Dec. 8, 1998

(86) PCT No.: PCT/NL98/00700

§ 371 (c)(1),
(2), (4) Date: Aug. 14, 2000

(87) PCT Pub. No.: WO99/29444

PCT Pub. Date: Jun. 17, 1999

(30) Foreign Application Priority Data

Dec. 8, 1997 (NL) ..... 1007732
Dec. 9, 1997 (NL) ..... 1007739

(51) Int. Cl.[7] ..... C21D 7/13

(52) U.S. Cl. ..... 148/541; 148/546; 148/602; 148/657

(58) Field of Search ..... 148/541, 601, 148/602, 656, 657, 658, 546

(56) References Cited

U.S. PATENT DOCUMENTS

| | | | | |
|---|---|---|---|---|
| 3,753,796 A | | 8/1973 | Melloy et al. | |
| 4,226,108 A | * | 10/1980 | Wilmotte et al. | 72/201 |
| 4,316,753 A | | 2/1982 | Kaneko et al. | |
| 4,790,889 A | | 12/1988 | Maid et al. | |
| 4,861,390 A | | 8/1989 | Satoh et al. | |
| 5,470,529 A | | 11/1995 | Nomura et al. | |
| 5,802,902 A | * | 9/1998 | Rosenthal et al. | 72/201 |
| 5,830,293 A | | 11/1998 | Meyer et al. | |
| 6,027,581 A | * | 2/2000 | Osawa et al. | 148/330 |
| 6,533,876 B1 | | 3/2003 | Cornelissen et al. | |

FOREIGN PATENT DOCUMENTS

| | | | |
|---|---|---|---|
| BE | 843939 | | 11/1976 |
| DE | 19520832 | | 4/1996 |
| DE | 19600990 | | 7/1997 |
| EP | 0306076 | | 3/1989 |
| EP | 0370575 | | 5/1990 |
| EP | 0524162 | | 1/1993 |
| EP | 524162 A | * | 1/1993 |

(List continued on next page.)

OTHER PUBLICATIONS

"Endless Rolling in Hot Strip Production", http://kawasaki–steel–21st–cf.or.jp/chapter_6/6i_1.html, 1997–2002.*

Machine Translation of JP 07–242947.

U.S. patent application Publication No. US 2002/0095764 in the name of Bald et al. published on Jul. 25, 2002.

*Primary Examiner*—George Wyszomierski
*Assistant Examiner*—Janelle Combs Morillo
(74) *Attorney, Agent, or Firm*—Stevens, Davis, Miller & Mosher, LLP

(57) ABSTRACT

A process and device for producing a high-strength steel strip. In the process, liquid steel is cast in at least one continuous-casting machine (1) with one or more strands to form a slab and, utilizing the casting heat, is conveyed through a furnace device (7). The slab undergoes preliminary rolling in a preliminary rolling device (10) and, in a final rolling device (14), is finishing-rolled to form a steel strip with the desired final thickness. In a continuous, endless or semi-endless process, the slab undergoes preliminary rolling in, essentially, the austenitic range in the preliminary rolling device (10) and, in the final rolling device (14), is rolled in the austenitic range or, in at lest one stand of the final rolling device (14), is rolled in the two-phase austenitic-ferritic range, the austenitic or austenitic, ferritic rolled strip. After leaving the final rolling device (14), the strip is cooled rapidly to obtain the desired structure.

12 Claims, 1 Drawing Sheet

FOREIGN PATENT DOCUMENTS

| | | | |
|---|---|---|---|
| EP | 0750049 | | 12/1996 |
| GB | 1493230 | | 11/1977 |
| JP | 61204331 | | 9/1986 |
| JP | 07242947 | | 9/1995 |
| WO | 9200815 | | 1/1992 |
| WO | WO 97/01402 | * | 1/1997 |
| WO | WO 97/23319 | * | 7/1997 |
| WO | 9746332 | | 12/1997 |

* cited by examiner

PROCESS AND DEVICE FOR PRODUCING A HIGH-STRENGTH STEEL STRIP

FIELD OF THE INVENTION

The invention relates to a process for producing a high-strength steel strip and to a device which is suitable for carrying out the process.

BACKGROUND OF THE INVENTION

In a known process for producing a high-strength steel strip, the starting point is a hot-rolled strip which has been manufactured in the conventional way and undergoes a two-stage cooling on the roll-out table. In a first stage, the austenitic strip is cooled until it is in the austenitic-ferritic mixed range and is held in that range until a desired amount of ferrite has been formed. Then, the strip is cooled at a high cooling rate in order to obtain a martensite structure in the strip. A high-strength steel of this nature is known under the name Dual-Phase steel.

SUMMARY OF THE INVENTION

One object of the present invention is to provide a process which provides greater flexibility in the production of high-strength steel. Another object which the invention seeks to achieve is that of providing a process which can be carried out using simple means. These objects and other advantages are achieved by means of a process for producing a high-strength steel strip, in which liquid steel is cast in at least one continuous-casting machine with one or more strands to form a slab and, utilizing the casting heat, is conveyed through a furnace device, undergoes preliminary rolling in a preliminary rolling device and, in a final rolling device, is finishing-rolled to form a steel strip with the desired final thickness, and, in a continuous, endless or semi-endless process, the slab undergoes preliminary rolling in, essentially, the austenitic range in the preliminary rolling device and, in the final rolling device is rolled in the austenitic range or, in at least one stand of the final rolling device, is rolled in the two-phase austenitic-ferritic range and the austenitic or austenitic-ferritic rolled strip, after leaving the final rolling device, is cooled rapidly in order to obtain the desired structure.

The process is based on a continuous, endless or semi-endless process. In a process of this nature, very good temperature control is possible both over the length, the width and the thickness of the slab or the strip. Moreover, the temperature homogeneity as a function of time is very good. A device for carrying out this process is generally equipped with cooling means, so that the temperature profile as a function of the location in the installation and/or as a function of time is also readily controllable and adjustable. An additional advantage which can be cited is that the process is particularly suitable for the use of a vacuum tundish in order to adapt the steel composition to the desired properties which are to be obtained.

Owing to the high level of temperature homogeneity, it is very much possible to carry out rolling in an accurately predictable manner in the two-phase austenitic-ferritic range. Scarcely any, or no, difference in the austenite-ferrite percentage occurs across the cross section of the strip and along the length of the strip. The conventional process can only comply with the level of temperature homogeneity which is required in order to obtain homogeneous properties to a limited extent or by means of special measures.

Consequently, the high-strength steel strip manufactured in the conventional way presents inhomogeneities both in cross section and in the longitudinal direction.

One embodiment of the process according to the invention is characterized in that the strip is rolled, in the final rolling device, at a temperature at which a desired amount of ferrite is present, and in that the strip leaving the final rolling device is cooled rapidly to a temperature below Ms (start martensite) within the temperature range in which martensite is formed.

Owing to the very good level of temperature homogeneity, it is possible to set and maintain a desired austenite-ferrite ratio in the final rolling device. After leaving the final rolling device, the strip is cooled very quickly, during which cooling the austenite is transformed into martensite, resulting in a high-strength strip.

It will be clear to the person skilled in the art that it is also possible to carry out the process in such a manner that the strip is rolled entirely in the austenitic range and leaves the final rolling device as an austenitic strip. A strip rolled in this way will also exhibit a very high level of temperature homogeneity both in cross section and in the longitudinal direction. The conventional method for producing Dual-Phase steel by means of two-stage cooling can advantageously be produced on a strip of this nature.

Another embodiment of the process according to the invention is characterized in that the strip is rolled, in the final rolling device, at a temperature at which a desired amount of ferrite is present, and in that the strip leaving the final rolling device is cooled rapidly to a temperature above Ms (start martensite) and at a cooling rate at which bainite is formed. In this embodiment of the invention, a desired ratio between austenite and ferrite is again created and, owing to the good level of temperature homogeneity, is equally distributed over the strip. The selection of the cooling rate and cooling temperature means that part of the austenite is converted into bainite, between which residual austenite remains. During the subsequent deformation of the steel strip when making products, the austenite generates dislocations which provide the high-strength steel with the property of deformability. The result is a steel strip with high-strength and high-ductility. Owing to these properties, these steel grades are also known as TRIP steel (transformation induced plasticity). The steel strip is coiled in the bainite range. The entire process of bainite formation and the formation of residual austenite is dependent on alloying elements. It is therefore particularly advantageous, when producing this type of steel, to make use of a vacuum tundish, which allows the composition of the steel to be adapted so as to match the desired properties right up until the last moment before the slab is cast in the continuous-casting machine.

In order to obtain not only a good level of temperature homogeneity but also a good distribution of the deformation over the cross section of the strip, a further embodiment of the process according to the invention is characterized in that on at least one stand, preferably all the stands, of the preliminary rolling device and/or on at least one stand, preferably every stand, of the final rolling device, lubricating rolling is carried out. Lubricating rolling ensures that the reduction applied by the rollers is distributed homogeneously through that part of the steel strip or the steel slab which is situated between the rollers. EP-A-0 750 049 describes a hot rolling process for the production of a dual-phase steel. A combination of alloying with specific elements and the use of specific cooling and coiling temperatures is disclosed. There is no disclosure in this document of employing a single-line process, starting from continuously casting of liquid steel.

Similar remarks apply to the disclosures in U.S. Pat. No. 4,790,889; U.S. Pat. No. 5,470,529 and U.S. Pat. No. 4,316,753.

EP-A-0 370 575 also describes a method in which a steel strip is produced in a single line, starting from continuously casting of liquid steel. This document does not, however, disclose the production of a high-strength steel strip. Also the cooling of the strip there is performed prior to the final rolling action instead of thereafter and prior to the coiling of the steel strip.

The invention is also embodied by a device for producing a steel strip, suitable in particular for carrying out a process according to the invention, comprising at least one continuous-casting machine for casting thin slabs, a furnace device for homogenizing a slab, which has optionally undergone preliminary size reduction, and a rolling device for rolling the slab down to a strip with the desired final thickness, and a coiler device for coiling the strip, which is characterized in that a cooling device with a cooling capacity of at least 2 $MW/m^2$ is placed between the final rolling mill stand of the rolling device and the coiler device.

BRIEF DESCRIPTION OF THE PREFERRED EMBODIMENTS

The invention will now be explained in more detail with reference to a non-limiting embodiment according to the drawing, in which.

DETAILED DESCRIPTION OF THE DRAWINGS

Figures 1, 2, 3:
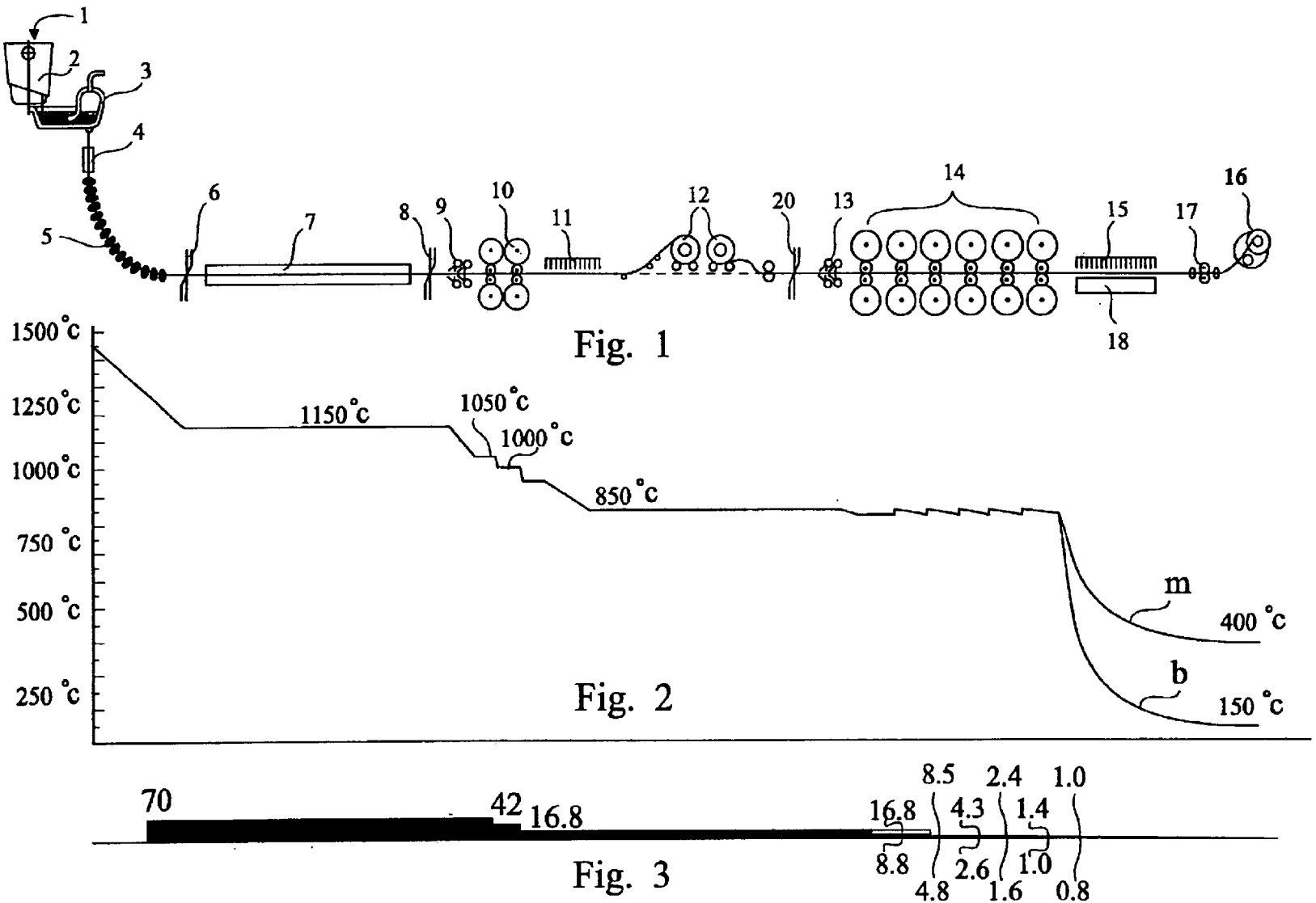
FIG. 1 shows a diagrammatic side view of a device with which the process according to the invention can be carried out.
FIG. 2 shows a graph illustrating the temperature profile in the steel as a function of the position in the device.
FIG. 3 shows a graph illustrating the thickness profile of the steel as a function of the position in the device.

In FIG. 1, reference numeral 1 indicates a continuous-casting machine for casting thin slabs. In this introductory description, this term is understood to mean a continuous-casting machine for casting thin slabs of steel with a thickness of less than 150 mm, preferably less than 100 mm, more preferably less than 80 mm, The continuous-casting machine may comprise one or more strands. It is also possible for a plurality of casting machines to be positioned next to one another. These embodiments fall within the scope of the invention. Reference numeral 2 indicates a casting ladle from which the liquid steel which is to be cast is fed to a tundish 3, which in this design is in the form of a vacuum tundish. The tundish is preferably provided with means, such as metering means, mixing means and analysis means, for setting the chemical composition of the steel to a desired composition, since in the present invention the composition is important. Beneath the tundish 3, there is a casting mould 4 into which the liquid steel is cast and at least partially solidified. If desired, casting mould 4 may be equipped with an electromagnetic brake. The standard continuous-casting machine has a casting speed of approx. 6 m/min; additional measures, such as a vacuum tundish and/or an electromagnetic brake provide the prospect of casting rates of 8 m/min or more. The solidified thin slab is introduced into a tunnel furnace 7 which has a length of, for example, 250–330 m. As soon as the cast slab has reached the end of the furnace 7, the slab is cut into slab sections in a semi-endless process using the shearing device 6. A semi-endless process is understood to mean a process in which a number of coils, preferably more than three, more preferably more than five coils, of the standard coil size are rolled from a single slab or slab section, in a continuous rolling process in at least the final rolling device, so as to give the final thickness. In an endless rolling process, the slabs or, after the preliminary rolling device, strips are coupled together so that an endless rolling process can be carried out in the final rolling device. In a continuous process, a slab moves through the path between continuous-casting machine and exit side of the rolling device without interruption. The invention is explained here on the basis of a semi-endless process, but can obviously also be used for an endless or continuous process. Each slab section represents a quantity of steel corresponding to five to six conventional coils. In the furnace, there is room to store a number of slab sections of this nature, for example to store three slab sections. As a result, those parts of the installation which lie downstream of the furnace can continue to operate while the casting ladle in the continuous-casting machine is being changed and the casting of a new slab is to commence, or while the continuous-casting machine has a fault, and also ensures that the continuous-casting machine can continue to operate if a fault arises downstream. Also, storage in the furnace increases the residence time of the slab sections therein, resulting in improved temperature homogenization of the slab sections. The speed at which the slab enters the furnace corresponds to the casting speed and is therefore approx. 0.1 m/sec. Downstream of furnace 7, there is an oxide-removal device 9, in this case in the form of high-pressure water jets with a pressure of approx. 400 atmosphere, for blasting off the oxide which has formed on the surface of the slab. The speed at which the slab passes through the oxide-removal installation and enters the preliminary rolling device 10 is approx. 0.15 m/sec. The rolling device 10, which fulfils the function of the preliminary rolling device, comprises two four-high stands, which are preferably equipped with a device for roller lubrication. If desired, a shearing device 8 may be included for emergency situations.

It can be seen from FIG. 2 that the temperature of the steel slab, which is approximately 1450° C. on leaving the tundish, falls in the rolling stand to a level of approx. 1150° C., and the slab is homogenized in the furnace device at that temperature. The intensive spraying with water in the oxide-removal device 9 causes the temperature of the slab to fall from approximately 1150° C. to approximately 1050° C. In the two rolling mill stands of the preliminary rolling device 10, the temperature of the slab falls, with each rolling pass, by another approximately 50° C., so that the slab, the thickness of which was originally approximately 70 mm and which is formed in two steps, with an interim thickness of 42 mm, into a steel strip with a thickness of approx. 16.8 mm, is at a temperature of approximately 950° C., i.e. in the austenitic range. The thickness profile as a function of the location is shown in FIG. 3 for two situations, one in which a strip with a final thickness of 0.8 mm is being rolled and one in which a strip with a final thickness of 1.0 mm is being rolled. The numbers indicate the thickness in mm. A cooling device 11, a set of coil boxes 12 and, if desired, an additional furnace device (not shown) are accommodated downstream of the preliminary rolling device 10. The strip emerging from the rolling device 10 may be temporarily stored and homogenized in the coil boxes 12, and if an additional increase in temperature is required, may be heated in the heating device (not shown) which is positioned downstream of the coil box. It will be obvious to the person skilled in the art that cooling device 11, coil boxes 12 and the furnace device which is not shown may be in different positions with respect to one another from those mentioned above. As a result of the reduction in thickness, the rolled strip enters the coil boxes at a speed of approx. 0.6 m/sec. By means of the cooling device 11, the strip is cooled until it is in the two-phase austenitic-ferritic range. It is also possible for the strip not to be cooled, or only to be cooled to a limited extent, or to be heated, in order to obtain an austenitically rolled strip on the exit side of the final rolling device 14. This cooling device may also be accommodated between rolling stands of the final rolling installation. It is also possible to utilize natural cooling, optionally between roller stands. A second oxide-removal installation 13, water pressure approx. 400 atmosphere, is positioned downstream of the cooling device 11, coil boxes 12 or furnace device (not shown), for the purpose of again removing an oxide skin which may have formed on the surface of the rolled strip. If desired, another shearing device may be included so as to top and tail a strip. The strip is then introduced into a rolling train which may be in the form of six four-high rolling mill stands which are positioned one behind the other and are preferably designed with a device for roller lubrication.

When producing an austenitic strip, it is possible to achieve the desired final thickness of between for example, 1.0 and 0.6 mm by using only five rolling mill stands. The thickness which is achieved by each rolling mill stand is indicated, for a slab thickness of 70 mm, in the top row of figures in FIG. 3. After leaving the rolling train 14, the austenitically-ferritically rolled strip, which is then at a final temperature of approximately 850° C. and has a thickness of 0.6 mm, is intensively cooled by means of a cooling device 15 and is coiled onto a coiling device 16. The speed at which it enters the coiling device is approx. 13–25 m/sec. A cooling device as described in ECSC final report 7210-EA/214 can be used for cooling purposes. The contents of this report are hereby deemed to be incorporated in the present application. Significant advantages of this cooling device are the wide control range, the high cooling capacity per unit surface area and the homogeneity of the cooling.

The cooling 15 is adjusted and controlled depending on whether it is desired to form martensite or bainite. It is possible to start with an austenitic strip and to cool it using a two-stage cooling, in which case in the first stage cooling is carried out until a desired amount of ferrite has been formed, followed by rapid cooling in order to form martensite. It is also possible for a strip which has been rolled in the two-phase range to be cooled rapidly so as to form martensite (curve m). It is also possible to cool an austenitic strip until a desired amount of ferrite has been formed and then to continue cooling in such a manner that bainite with residual austenite is formed. In addition, it is possible to roll the strip in the two-phase range and then, if necessary, to continue cooling in such a manner that bainite with residual austenite is formed (curve b).

If appropriate, oxide is removed from the strip in oxide-removal installation 13. If the exit temperature from rolling train 14 is too low, it is possible, by means of a furnace device 18 which is located downstream of the rolling train, to bring a ferritically rolled strip up to a desired coiling temperature. Cooling device 15 and furnace device 18 may be positioned next to one another or one behind the other. It is also possible to replace one device with the other device depending on whether austenitic or austenitic-ferritic strip is being produced. A shearing device 17 is included in order to cut the strip to the desired length, corresponding to standard coil dimensions. By suitably selecting the various components of the device and the process steps carried out by means of the device, such as homogenization, rolling, cooling and temporary storage, it has proven possible to operate this device using a single continuous-casting machine, whereas in the prior art two continuous-casting machines are used in order to match the limited casting speed to the much higher rolling speeds which are customarily used. The device is suitable for strips with a width which lies in the range between 1000 and 1500 mm and a thickness, in the case of an austenitically rolled strip, of approx. 1.0 mm or a thickness, in the case of a ferritically rolled strip, of approx. 0.5 to 0.6 mm. The homogenization time in the furnace device 7 is approximately ten minutes for storing three slabs of the length of the furnace. The coil box is suitable for storing two complete strips in the case of austenitic rolling.

What is claimed is:

1. A process for producing high-strength steel strip comprising:

casting liquid steel in at least one continuous-casting machine with one or more strands to form a slab having a thickness of less than 150 mm;

conveying the slab, while utilizing casting heat, through a furnace device;

preliminarily rolling the slab with a preliminary rolling device, having at least one stand, to form a preliminarily rolled product;

finish-rolling the preliminarily rolled product in a final rolling device, having at least one stand, to form a steel strip with the desired final thickness, wherein the slab undergoes said preliminary rolling in, essentially an austenitic range in the preliminary rolling device and, in the final rolling device rolling the preliminarily rolled product in an austenitic range or, in at least one said stand of the final rolling device, rolling in a two-phase austenitic-ferritic range, said preliminary rolling and said final rolling are both in an endless or semi-endless process; and rapidly cooling the austenitic or austenitic-ferritic rolled strip, after leaving the final rolling device, in order to obtain a desired temperature.

2. The process according to claim 1, wherein said final rolling is performed at a temperature at which a desired amount of ferrite is present, and the rapid cooling of the strip leaving the final rolling device is to a temperature below Ms (start martensite), within the temperature range in which martensite is formed.

3. The process according to claim 1, wherein said final rolling is performed a temperature at which a desired amount of ferrite is present, and the rapid cooling of the strip leaving the final rolling device is cooling to a temperature above Ms (start martensite), and at a cooling rate at which bainite is formed.

4. The process according to claim 1, wherein said preliminary rolling comprises lubricating rolling the slab, on at least one said stand of the preliminary rolling device.

5. The process according to claim 1, wherein said preliminary rolling comprises lubricating rolling the slab on every stand of the preliminary rolling device.

6. The process of claim 1, wherein said final rolling comprises lubricating rolling the preliminarily rolled product on at least one said stand of the final rolling device.

7. The process according to claim 1, wherein said preliminary rolling comprises lubricating rolling the slab on at least one said stand of the preliminary rolling device and said final rolling comprises lubricating rolling the preliminarily rolled product on at least one said stand of the final rolling device.

8. The process according to claim 1, wherein said final rolling comprises lubricating rolling, on every said stand of the final rolling device.

9. The process according to claim 1, wherein said preliminary rolling comprises lubricating rolling the slab, on every said stand of the preliminary rolling device and final rolling comprises lubricating rolling the preliminarily rolled product, on every said stand of the final rolling device.

10. The process according to claim 1, wherein said casting produces a slab having a thickness of less than 100 mm.

11. The process according to claim 1, wherein the rolling of the preliminary rolled product in the final rolling device is in the austenitic range.

12. The process according to claim 1, wherein the final rolling of the preliminary rolled product in the final rolling device is in the two-phase austenitic-ferritic range.

* * * * *